US009097052B2

(12) United States Patent
Chen et al.

(10) Patent No.: US 9,097,052 B2
(45) Date of Patent: Aug. 4, 2015

(54) REFRIGERATOR

(75) Inventors: Hao Chen, Hefei (CN); Yanping Xu, Hefei (CN)

(73) Assignees: HEFEI MIDEA REFRIGERATOR CO., LTD., Hefei (CN); HEFEI HUALING CO., LTD., Hefei (CN)

( * ) Notice: Subject to any disclaimer, the term of this patent is extended or adjusted under 35 U.S.C. 154(b) by 0 days.

(21) Appl. No.: 14/363,330

(22) PCT Filed: Dec. 6, 2011

(86) PCT No.: PCT/CN2011/083591

§ 371 (c)(1),
(2), (4) Date: Jun. 6, 2014

(87) PCT Pub. No.: WO2013/082767

PCT Pub. Date: Jun. 13, 2013

(65) Prior Publication Data

US 2014/0319992 A1 Oct. 30, 2014

(51) Int. Cl.

| | |
|---|---|
| ***A47B 96/04*** | (2006.01) |
| ***E05F 15/12*** | (2006.01) |
| ***F25D 23/02*** | (2006.01) |
| ***E05F 15/63*** | (2015.01) |

(52) U.S. Cl.

CPC ..... *E05F 15/127* (2013.01); *E05F 15/63* (2015.01); *F25D 23/02* (2013.01); *F25D 23/028* (2013.01); *E05Y 2201/426* (2013.01); *E05Y 2800/73* (2013.01); *E05Y 2900/31* (2013.01); *F25D 2323/021* (2013.01)

(58) Field of Classification Search

CPC ... E05F 15/127; E05F 17/00; E05F 2017/008; E05F 15/611; E05F 15/63; F25D 23/028; F25D 2400/06; F25D 2323/021; F25D 23/02; E05Y 2900/31; E05Y 2201/426; E05Y 2800/73; E05B 17/0033

USPC ..... 312/405, 401, 324, 319.2, 319.5, 319.6, 312/327

See application file for complete search history.

(56) References Cited

U.S. PATENT DOCUMENTS

| | | | | |
|---|---|---|---|---|
| 6,338,536 | B1 * | 1/2002 | Ueno et al. | 312/405 |
| 6,375,291 | B1 * | 4/2002 | Nam et al. | 312/405 |
| 7,448,705 | B2 * | 11/2008 | Park | 312/405 |
| 7,819,488 | B2 * | 10/2010 | Lee et al. | 312/405 |
| 8,132,876 | B2 * | 3/2012 | An et al. | 312/405 |
| 8,297,725 | B2 * | 10/2012 | Kim et al. | 312/405 |
| 2006/0097612 | A1 * | 5/2006 | Park | 312/405 |
| 2006/0107597 | A1 * | 5/2006 | Jin et al. | 49/149 |
| 2008/0066481 | A1 * | 3/2008 | An et al. | 62/265 |

(Continued)

*Primary Examiner* — Daniel J Troy
*Assistant Examiner* — Hiwot Tefera
(74) *Attorney, Agent, or Firm* — Hodgson Russ LLP

(57) ABSTRACT

A refrigerator, includes a cabinet having a refrigerating compartment therein; a door pivotably coupled with the cabinet to open or close the refrigerating compartment; and an auxiliary door-opening device. The auxiliary door-opening device includes: a swing arm, a servo driver which is disposed on the cabinet, has an output shaft coupled with the swing arm, and is configured to drive the swing arm to swing between a first predetermined position in which the swing arm pushes the door to separate from the cabinet and a second predetermined position in which the door is closed onto the cabinet; and a controller configured to actuate the servo driver when receiving a door-opening instruction, so that the servo driver drives the swing arm to move to the first predetermined position and then to return to the second predetermined position.

6 Claims, 2 Drawing Sheets

(56) References Cited

U.S. PATENT DOCUMENTS

2008/0134698 A1* 6/2008 Cho et al. ..... 62/127
2010/0141107 A1* 6/2010 Kim et al. ..... 312/405
2011/0016907 A1* 1/2011 Kang et al. ..... 62/449
2012/0146479 A1* 6/2012 An et al. ..... 312/405

* cited by examiner

REFRIGERATOR

FIELD

The present invention relates to the field of refrigeration, and more particularly to a refrigerator.

BACKGROUND

With the refrigerator, especially a large refrigerator, in the related art, after the door is closed, the door is not easy to open. This may be mainly caused by the flowing factors. The door of the large refrigerator is large in dimension and heavy. After the refrigeration, the temperature inside the cabinet is low, and the pressure inside the cabinet is decreased, while there is no change in the atmospheric pressure outside of the refrigerator, such that the door is difficult to open. In addition, the magnetic strip of the door of the refrigerator has a large dimension, and accordingly the suction force of the door seal is large.

SUMMARY

Embodiments of the present invention seek to solve at least one of the problems in the related art to at least some extent.

Accordingly, an object of the present invention is to provide a refrigerator which is easy and high in comfort during the door-opening process.

A refrigerator according to embodiments of the present invention includes a cabinet having a refrigerating compartment therein; a door pivotably coupled with the cabinet to open or close the refrigerating compartment; and an auxiliary door-opening device comprising: a swing arm, a servo driver which is disposed on the cabinet, has an output shaft coupled with the swing arm, and is configured to drive the swing arm to swing between a first predetermined position in which the swing arm pushes the door to separate from the cabinet and a second predetermined position in which the door is closed onto the cabinet; and a controller configured to actuate the servo driver when receiving a door-opening instruction, so that the servo driver drives the swing arm to move to the first predetermined position and then to return to the second predetermined position.

With the refrigerator according to embodiments of the present invention, by providing the auxiliary door-opening device, when a user needs to open the door of the refrigerator, the door-opening instruction is generated and sent, and the controller controls the servo driver to drive the swing arm to move to the first predetermined position and to push the door to separate from the cabinet. After the door is separated from the cabinet, the user only needs to apply a small force to open the door completely. The auxiliary door-opening device has a simple structure, which may be realized without greatly modifying the structure of the refrigerator in the related art, thus enhancing the comfort during the use of the refrigerator.

In addition, the refrigerator according to the above embodiments of the present invention may also have the following additional technical features.

In one embodiment, an abutting member is disposed on the door, and configured to be abuttable against the swing arm.

In one embodiment, a free end of the swing arm has an arc-shaped surface, and a part of the abutting member to be abutted against the free end of the swing arm is matched with the arc-shaped surface.

In one embodiment, the swing arm is disposed on a top surface of the cabinet, and the abutting member is disposed on a top surface of the door.

In one embodiment, the servo driver is imbedded into a case of the cabinet.

In one embodiment, the refrigerator further includes: a door-opening trigger disposed on one of the door and the cabinet, and configured to send the door-opening instruction to the controller.

In one embodiment, the door-opening trigger is disposed on a handle of the door.

In one embodiment, the refrigerator is a side-by-side refrigerator comprising left and right doors.

In one embodiment, the servo driver is configured to drive the swing arm to swing between the first predetermined position and the second predetermined position, the swing arm pushes the left door to separate from the cabinet when the swing arm is in the first predetermined position; and the servo driver is configured to drive the swing arm to swing between the second predetermined position and a third predetermined position, the swing arm pushes the right door to separate from the cabinet when the swing arm is in the third predetermined position.

In one embodiment, the second predetermined position is a position between the left and right doors when the left and right doors are closed.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

Figure 1:
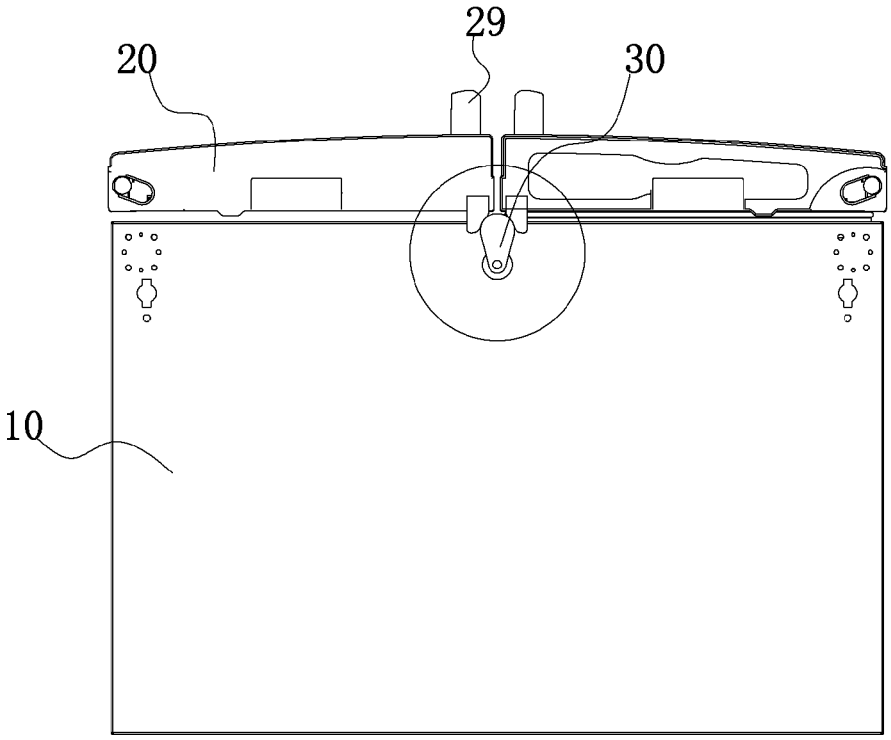
FIG. 1 is a schematic view of a refrigerator having a door in a closed state according to an embodiment of the present invention.

Reference will be made in detail to embodiments of the present invention. The embodiments described herein with reference to drawings are explanatory, illustrative, and used to generally understand the present invention. The embodiments shall not be construed to limit the present invention. The same or similar elements and the elements having same or similar functions are denoted by like reference numerals throughout the descriptions.

In the specification, it is to be understood that terms such as "central," "longitudinal," "upper," "lower," "front," "rear," "left," "right," "vertical," "horizontal," "top," "bottom," and "inner," "outer," should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

The refrigerator according to embodiments of the present invention will be described below with reference to the drawings.

As shown in FIGS. 1-4, the refrigerator according to an embodiment of the present invention includes a cabinet 10, a door 20 and an auxiliary door-opening device 30.

Specifically, the cabinet 10 has a refrigerating compartment defined therein.

The door 20 is pivotably coupled with the cabinet 10 to open or close the refrigerating compartment.

The auxiliary door-opening device 30 includes a servo driver 31, a swing arm 32, and a controller.

Specifically, the servo driver 31 is disposed on the cabinet 10. For example, the servo driver 31 is fixedly mounted on the cabinet 10.

The swing arm 32 is coupled with the output shaft 311 of the servo driver 31, so that the swing arm 32 may rotate along with the output shaft 311. For example, the servo driver 31 drives the swing arm 32 to swing between a first predetermined position (i.e. a position of the swing arm 32 shown in FIG. 3) and a second predetermined position (i.e. a position of the swing arm 32 shown in FIG. 1).

When the swing arm 32 is in the first predetermined position, the swing arm 32 pushes the door 20 to separate from the cabinet 10, so that the refrigerating compartment is communicated with the external environment. When the swing arm 32 is in the second predetermined position, the door 20 is closed onto the cabinet 10, i.e. the door 20 is in a position of closing the refrigerating compartment.

The controller actuates the servo driver 31 when receiving a door-opening instruction, so that the servo driver 31 drives the swing arm 32 to move to the first predetermined position and then to return to the second predetermined position.

In other words, when receiving the door-opening instruction, the controller drives the swing arm 32 to move to the first predetermined position, and drives the swing arm 32 to return to the second predetermined position after the swing arm 32 pushes the door 20 to separate from the cabinet 10.

With the refrigerator according to embodiments of the present invention, by providing the auxiliary door-opening device 30, when a user needs to open the door 20 of the refrigerator, the door-opening instruction is generated and sent, and the controller controls the servo driver 31 to drive the swing arm 32 to move to the first predetermined position so as to push the door 20 to separate from the cabinet 10. After the door 20 is separated from the cabinet 10, the user only needs to apply a small force to open the door 20 completely. The auxiliary door-opening device 30 has a simple structure, which may be realized without greatly modifying the structure of the refrigerator in the related art, thus enhancing the comfort during the use of the refrigerator.

Figure 2:
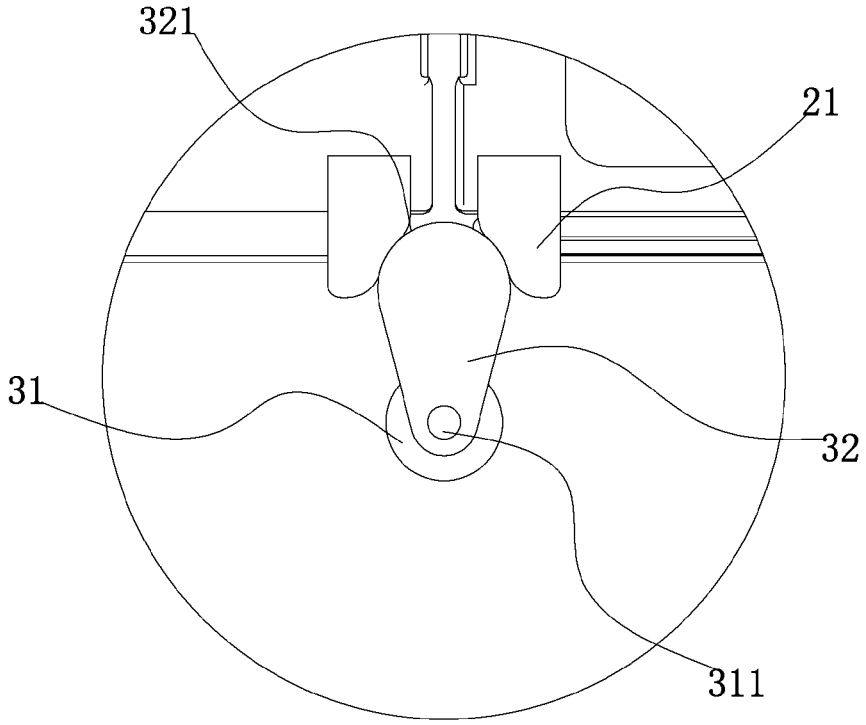
FIG. 2 is a schematic enlarged view of part A in FIG. 1.

As shown in FIG. 2, in an embodiment, an abutting member 21 is disposed on the door 20, and abuttable against the swing arm 32. Therefore, by providing the abutting member 21, direct contact between the swing arm 32 and the door 20 is avoided, such that the door 20 may be easily opened via the swing arm 32.

Further, a free end of the swing arm 32 has an arc-shaped surface 321, and a part of the abutting member 21 to be abutted against the free end of the swing arm 32 is matched with the arc-shaped surface 321. Therefore, when the swing arm 32 rotates from the second predetermined position to the first predetermined position, the output shaft 311 may rotate the swing arm 32 such that a distance from a contact point between the swing arm 32 and the abutting member 21 to the output shaft 311 is increased, until the swing arm 32 pushes the door 20 to leave the cabinet 10. Therefore, the door 20 is smoothly opened from the cabinet 10.

As shown in FIG. 1, the swing arm 32 is disposed on a top surface of the cabinet 10, and the abutting member 21 is disposed on a top surface of the door 20. Therefore, the auxiliary door-opening device 30 may be mounted to the refrigerator in the related art without greatly modifying the structure thereof. Meanwhile, it is possible to avoid contacting of the abutting member 21 and the swing arm 32 with the cold air in the refrigerating compartment, thus extending the service life of the auxiliary door-opening device 30.

In some embodiments, the servo driver 31 may be imbedded into a case of the cabinet 10. Therefore, the overall appearance of the refrigerator may not be changed, and the overall aesthetic property of the refrigerator may be enhanced.

In an embodiment, the refrigerator further includes a door-opening trigger (not shown) disposed on one of the door 20 and the cabinet 10, and used to generate and send the door-opening instruction to the controller. Therefore, the user may send the door-opening instruction conveniently.

Alternatively, the door-opening trigger is disposed on a handle 29 of the door 20. For example, the door-opening trigger may be a touch switch disposed on the handle 29 of the door 20. When the user grips the handle 29, the user touches the touch switch, the touch switch generates and sends the door-opening instruction to the controller, and the servo driver 31 (e.g., a servo motor) drives the swing arm 32 to swing.

Figure 3:
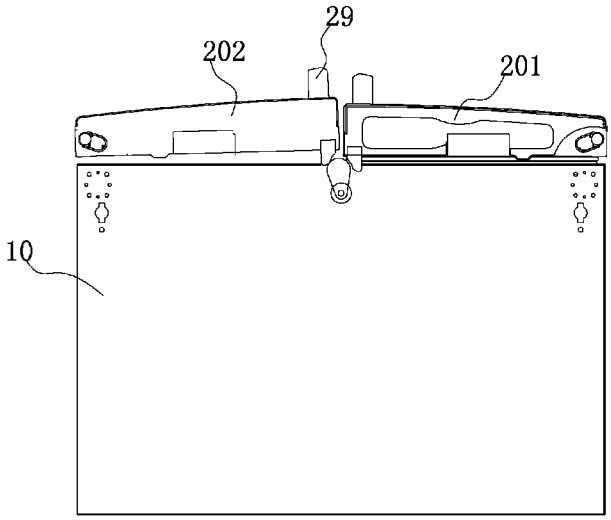
FIG. 3 is a schematic view of a refrigerator having a right door in an opened state according to an embodiment of the present invention.
Figure 4:
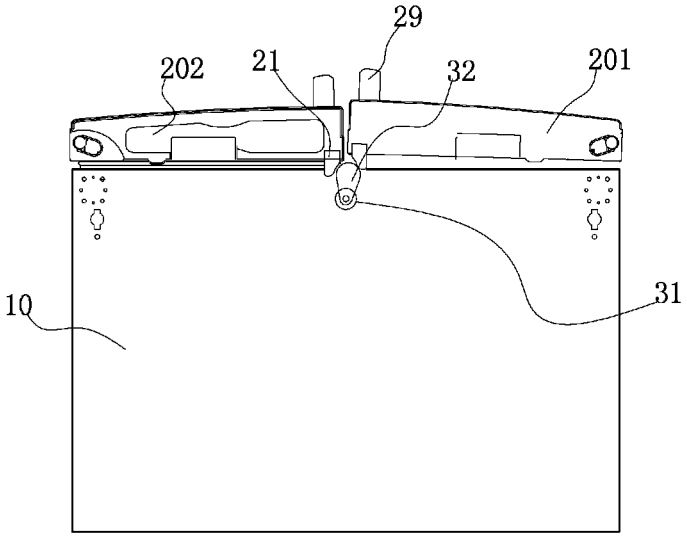
FIG. 4 is a schematic view of a refrigerator having a left door in an opened state according to an embodiment of the present invention.

As shown in FIGS. 3-4, in some embodiments, the refrigerator is a side-by-side type refrigerator including left and right doors 201, 202.

Further, the servo driver 31 (e.g., a servo motor) drives the swing arm 32 to swing between the first predetermined position (i.e. a position of the swing arm 32 shown in FIG. 4) and the second predetermined position, and the swing arm 32 pushes the left door 201 to separate from the cabinet 10 when the swing arm 32 is in the first predetermined position.

The servo driver 31 (e.g., a servo motor) drives the swing arm 32 to swing between the second predetermined position and a third predetermined position (i.e. a position of the swing arm 32 shown in FIG. 3), the swing arm 32 pushes the right door 202 to separate from the cabinet 10 when the swing arm 32 is in the third predetermined position.

It should be noted that, the second predetermined position is a position (i.e. a position of the swing arm 32 shown in FIG. 1) between the left and right doors 201, 202 when the left and right doors 201, 202 are closed.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A refrigerator, comprising:

a cabinet having a refrigerating compartment therein;

left and right doors, each door pivotably coupled with the cabinet to open or close the refrigerating compartment; and an auxiliary door-opening device comprising:

a swing arm;

a servo driver which is disposed on the cabinet, has an output shaft coupled with the swing arm, and is configured to drive the swing arm to swing between a first predetermined position in which the swing arm pushes either the left door or the right door to separate from the cabinet and a second predetermined position in which the left door or right door is closed onto the cabinet; and a controller configured to actuate the servo driver when receiving a door-opening instruction, so that the servo driver drives the swing arm to move to the first predetermined position and then to return to the second predetermined position;

wherein a respective abutting member is disposed on the left and right doors, and both of the abutting members are configured to be abuttable against the swing arm;

wherein a free end of the swing arm has an arc-shaped surface, and a part of each of the abutting members to be abutted against the free end of the swing arm has an arc-shaped surface that is matched with the arc-shaped surface of the swing arm;

wherein the swing arm is disposed on a top surface of the cabinet, each of the abutting members is disposed on a top surface of the respective door;

wherein each of the abutting members extends from the top surface of the respective door to a location above the top surface of the cabinet.

2. The refrigerator according to claim 1, wherein the servo driver is imbedded into a case of the cabinet.

3. The refrigerator according to claim 1, further comprising:

a door-opening trigger disposed on one of the left and right doors and the cabinet, and configured to send the door-opening instruction to the controller.

4. The refrigerator according to claim 3, wherein the door-opening trigger is disposed on a handle of the left and right doors.

5. The refrigerator according to claim 1, wherein the servo driver is configured to drive the swing arm to swing between the first predetermined position and the second predetermined position, the swing arm pushes the left door to separate from the cabinet when the swing arm is in the first predetermined position; and wherein the servo driver is configured to drive the swing arm to swing between the second predetermined position and a third predetermined position, the swing arm pushes the right door to separate from the cabinet when the swing arm is in the third predetermined position.

6. The refrigerator according to claim 1, wherein the second predetermined position is a position between the left and right doors when the left and right doors are closed.

* * * * *